US005632640A

United States Patent [19]

Noda

[11] Patent Number: 5,632,640

[45] Date of Patent: May 27, 1997

[54] INSERT AND ROTATE CONNECTOR WITH IMPROVED LATCHING MEANS

[75] Inventor: Atsuhito Noda, Hachioujui, Japan

[73] Assignee: Molex Incorporated, Lisle, Ill.

[21] Appl. No.: 560,606

[22] Filed: Nov. 20, 1995

[30] Foreign Application Priority Data

Jan. 20, 1995 [JP] Japan ..... 7-000636 U

[51] Int. Cl.[6] ..... H01R 4/38

[52] U.S. Cl. ..... 439/326; 439/328; 439/157; 439/160

[58] Field of Search ..... 439/326, 327, 439/328, 157, 159, 160

[56] References Cited

U.S. PATENT DOCUMENTS

| | | | |
|---|---|---|---|
| 3,216,580 | 11/1965 | Fricker, Jr. | 439/328 |
| 4,233,646 | 11/1980 | Leung et al. | 439/160 |
| 4,986,765 | 1/1991 | Korsunsky et al. | 439/326 |
| 5,057,032 | 10/1991 | Kaufman et al. | 439/326 |
| 5,064,381 | 11/1991 | Lin | 439/326 |
| 5,145,396 | 9/1992 | Yeung | 439/326 |
| 5,203,714 | 4/1993 | Tuan | 439/326 |
| 5,209,675 | 5/1993 | Korsunsky | 439/326 |
| 5,211,568 | 5/1993 | Yamada et al. | 439/157 |
| 5,226,833 | 7/1993 | Lwee | 439/326 |
| 5,244,403 | 9/1993 | Smith et al. | 439/326 |
| 5,372,518 | 12/1994 | Liu et al. | 439/326 |
| 5,383,792 | 1/1995 | Korsunsky et al. | 439/326 |
| 5,389,000 | 2/1995 | DiViesti et al. | 439/157 |
| 5,413,497 | 5/1995 | Lwee | 439/328 |
| 5,437,560 | 8/1995 | Mitzuguchi | 439/326 |
| 5,484,302 | 1/1996 | Yamada et al. | 439/326 |
| 5,490,044 | 2/1996 | Kobayashi et al. | 439/160 |

*Primary Examiner*—David L. Pirlot
*Assistant Examiner*—Tho D. Ta
*Attorney, Agent, or Firm*—Charles S. Cohen; James C. Paschall

[57] ABSTRACT

An insert and rotate edge card connector has a latching mechanism which includes a body portion held in a preloaded state within an end of an elongated connector housing. The latching mechanism includes a latch member having a rounded portion which engages the lateral ends of a circuit card. The latch member also includes a pair of retention arms which extend over the rounded portion to engage the circuit card in a plane different than that of the rounded portion.

19 Claims, 7 Drawing Sheets

INSERT AND ROTATE CONNECTOR WITH IMPROVED LATCHING MEANS

BACKGROUND OF THE INVENTION

The present invention relates generally to electrical connectors for use in association with printed circuit boards and, more particularly, to a connector having an improved latching means.

Connectors are used in all types of electronic devices, and are widely used in the computer field. Many computers and other electronic devices have a main printed circuit board, referred to in the art as a "mother" board. Secondary electrical circuits are formed on different substrates as separate printed circuit boards which are added to the mother board, either subsequent to the installation of the mother board in a housing of the device, or prior to the final installation of the mother board into the component housing. These secondary circuits are typically designed to improve the performance of the device and are referred to in the art as "daughter" boards.

A connector is typically used in the computer art to connect a daughter board to the mother board. To provide an effective connection, connectors include a number of conventional features such as a longitudinal slot which receives an edge of the daughter board and a plurality of electrical terminals disposed in the slot in alignment with a like plurality of electrical contact pads arranged along the edge of the daughter board. The connection is effected along this edge of the daughter boards, and accordingly, daughter boards are often descriptively referred to as "edge cards".

The connector terminals may typically include contact portions located in the connector housing which provide electrical contact between the connector and the edge card. The terminals also may include tail portions which extend out of the connector housing and which are received within corresponding holes in the mother board in order to provide a connection between the circuit(s) on the edge cards and the mother board. The electronics art and especially the computer art have noticed the desire of consumers for smaller computer devices as evidenced by the increase in popularity of "laptop" and "sub-notebook" computers, as well as smaller size desktop computers. In order to reduce space, connectors have been developed which are smaller than past connectors, and having a closer profile to the mother board. Sometimes, these low profile, or right angle connectors are designed in order to position the daughter board in a horizontal orientation, parallel to the mother board surface, rather than vertical and perpendicular to the mother board surface.

Right angle connectors are often used to provide electrical connections between memory modules, known in the art as either SIMMs (single in-line memory modules) or DIMMs (dual in-line memory modules). There is a primary difference between a SIMM and a DIMM which highlights the need for even more reliable connectors used with DIMMs. SIMMs typically contain their electrical contact pads along the opposing edges of the engagement edge of the SIMM in a redundant manner, i.e., a contact pad on one side of the SIMM has a corresponding contact pad disposed on the other side of the SIMM and the two contact pads are electrically connected to the same circuit.

The structure of a DIMM is different because each electrical contact pad on the opposing sides of the DIMM leads to a different circuit and, therefore requires a higher degree of certainty of contact between the connector terminal contact portions and the DIMM contact pads than a SIMM because of the lack of redundancy. If a break in contact occurs, disengagement of the connection established in the connector between the edge card contact pads and the terminal contact portions may result, potentially causing a computer failure.

Latching mechanisms have been developed for connectors in order to retain edge cards in place in the connector housing. Latching mechanisms for SIMMS are typically either directly formed in the structure of the connector housing at opposing ends, or they may be separately formed and inserted into the connector housing. These latching mechanisms may include different configurations for contacting the edge card and for retaining it in place within the connector housing. Examples of insertable latches are described in U.S. Pat. No. 4,995,825 issued Feb. 26, 1991 and U.S. Pat. No. 5,094,624, issued Mar. 10, 1992. The latches described in these patents are stamped and formed from a metal strip and are used in "insert and rotate" connectors wherein the engagement edge of the edge card is initially inserted into the connector slot and subsequently rotated to a second position in the connector slot into engagement with the terminals.

Another insert and rotate connector having a latching mechanism is described in European Patent Publication No. 0632542, published Jan. 4, 1994. The latching mechanism described in this patent includes latching members having a pair of wide shoulders which engage the ends of a circuit card and a tongue which is folded over the shoulders in order to contact the circuit card. Although these shoulders are illustrated as extending into opposing recesses positioned in the ends of an edge card, the entire latch arm is formed by stamping and forming the latching members over the shoulders. The tolerances in forming these latch members are not as accurate as may be obtained through blanking.

Small outline DIMM connectors of the type shown in European Patent Publication No. 0632542 are small in size and shape, and the latch members are likewise small. The difficultly in accurately stamping and forming a latch member increases as the overall size of the latch member decreases. In order to position the edge card accurately in the connector, such small outline DIMMs typically utilize a pair of notches or other style reentrant portions formed on the opposite ends of the edge card which engage an opposing surface of a latch member. The relatively small size of a DIMM and its lack of electrical redundancy requires that the latch member reliably hold the DIMM in place within the connector. It is desirable to engage the DIMM with the connector in a manner which will ensure accurate alignment and connection between the terminals and edge card contact pads and resist shock loading.

Accordingly, a need exists for a connector in which the edge card is inserted and rotated into position wherein the connector has a reliable latching mechanism which retains the edge card in place within the connector.

SUMMARY OF THE INVENTION

The present invention is therefore directed to an improved edge card connector of the insert and rotate style which offers significant advantages over the connectors described above, which is reliable and which offers improved resistance to shock loading and the like.

In one principal aspect, the present invention overcomes the aforementioned disadvantages by providing an edge card connector having an elongated housing with an edge card slot extending longitudinally therein between two opposing end portions. The housing has a plurality of contact-receiving cavities which intersect with and open into the edge card slot of the connector housing. Each contact-receiving cavity contains an individual terminal which engages an opposing contact pad formed on opposing surfaces of the edge card insertion edge, and the connector has a latching mechanism disposed at its opposite ends. The latching mechanism includes an insertable latch member held within a slot formed in an end portion of the connector housing. The latch member includes a projecting portion which engages a corresponding notch formed in an end of the edge card, the latch member having at least one retention member extending out from the projecting portion normal thereto which engages a surface of the edge card. The retention member further includes a cam surface disposed thereon which also extends generally normal to the card engaging projection and which a engages the edge card when the edge card rotated into place to move the latch members outwardly to accommodate the edge card.

In another principal aspect of the present invention, each of the latch members includes an insertable cantilevered latch which is held within the connector housing end portions. Each latch member includes a latch arm having an arcuate engagement portion having distinct upper and lower portions. The lower portion is received in an opposing notch portion of a DIMM edge card, while the upper portion includes a pair of blanked retention arms which extend outwardly therefrom over edges of the engagement portion lower portions to engage a surface of the edge card. The retention arms extend parallel to the edge card and apply a transverse force to it transverse to the edge card surfaces. The latch projecting engagement portions engage the lateral ends of the edge card and retain the edge card laterally within the connector housing card slot.

In still another principal aspect of the present invention, each latch member includes a ring projection formed in a body portion of the latch member, each ring projection having a pair of extensions blanked therefrom and extending outwardly from the ring projection. The ring extensions having inclined surfaces which extend away from the ring projection, the extrusions further extending past the outer radius of the ring projections to form an abutment which bears against the surface of the edge card.

In yet still another aspect of the present invention and as exemplified by a second embodiment thereof, the ring extensions are curved toward each other and a free end of each latch members is partially bent upon itself to form a manually manipulatable engagement portion by which the latch members may be spread apart from each other to release the edge card from its engagement position within the connector housing slot.

These and other objects and advantages of the present invention will be clearly understood through a consideration of the following detailed description and in which like reference numerals identify like parts.

BRIEF DESCRIPTION OF THE DRAWINGS

In the course of this description, reference will be made to the attached drawings in which.

DESCRIPTION OF THE PREFERRED EMBODIMENTS

Figure 13:
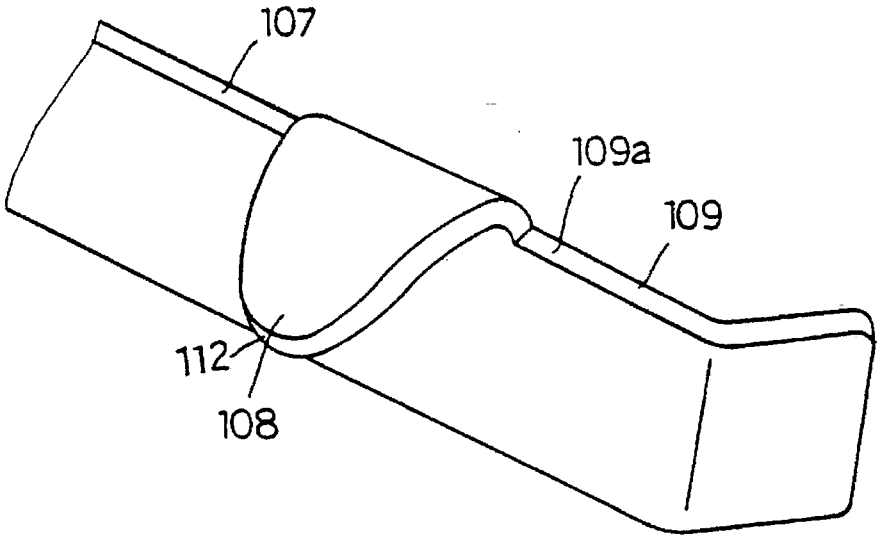
FIG. 13 PRIOR ART
FIG. 13 is a perspective view of a latching mechanism of a conventional electrical connector.
Figure 14:
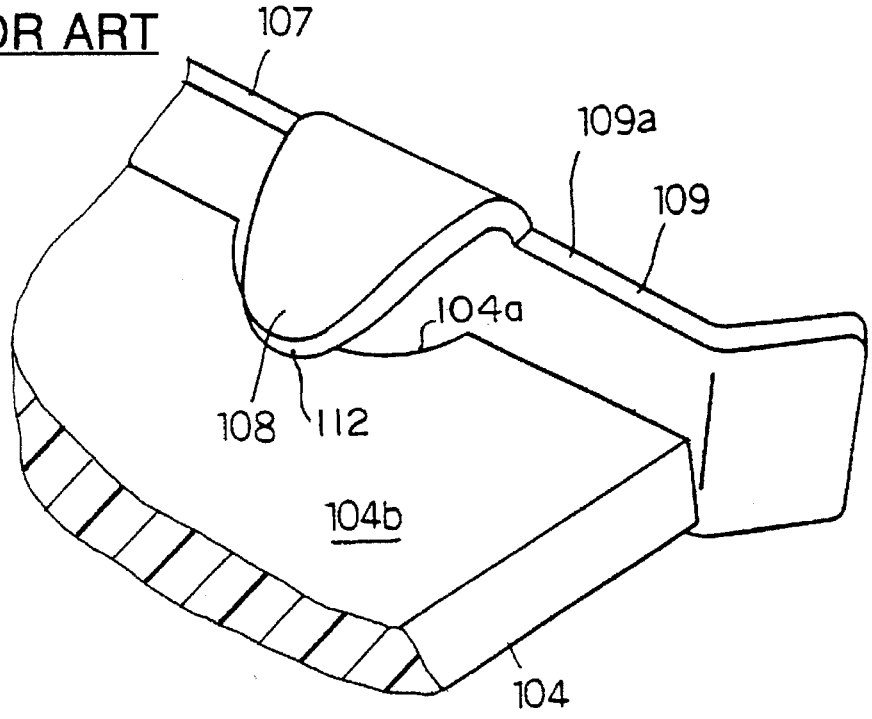
FIG. 14 PRIOR ART
FIG. 14 is a partial perspective view on the latch means of FIG. 13 in engagement with a corresponding opposing edge of a secondary circuit board in a latching condition.
Figure 15:
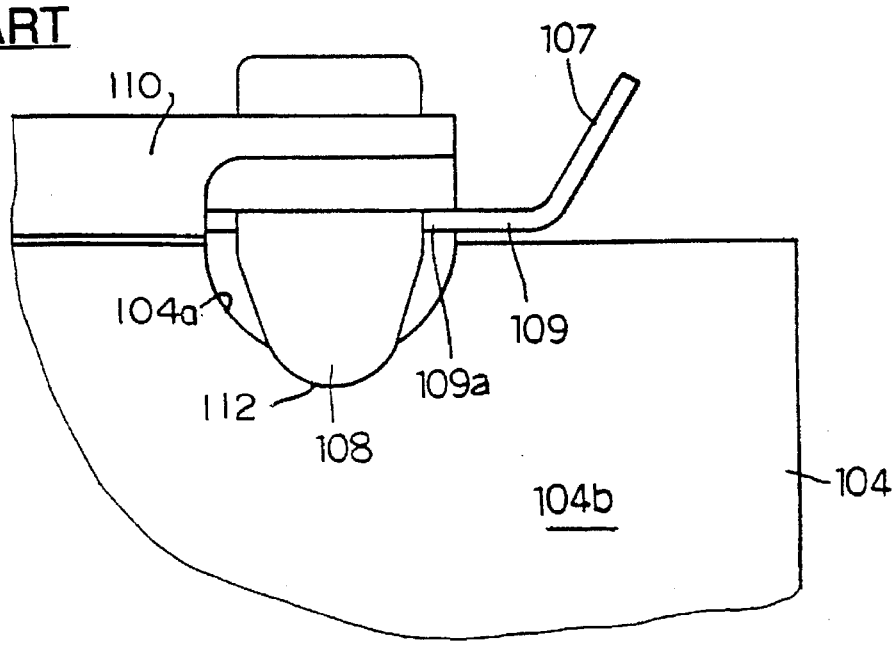
FIG. 15 PRIOR ART
FIG. 15 is a plan view of the latch means and corresponding in opposing secondary circuit board edge engage in a latching condition.

FIGS. 13–15 illustrate a conventional latch member 107 similar to that described in European Patent Publication No. 0632542 and utilized in a connector for retaining a DIMM in place within a connector (not shown) in order to establish a connection between the DIMM and a mother board. The latch member 107 includes an elongated latch arm 109 held within an elongated end portion 110 of a connector. The latch arm 109 includes a tongue, or retention member 108, which is stamped and formed from the same metal blank as the latch member 107. The tongue 108 is formed along the end **109*a* of the latch arm and is rolled more than 90° from the end 109*a* in order to confront the opposing surface 104*b* of an edge card 104**.

FIG. 14 illustrates an edge card or DIMM 104 in engagement with the latch member 107 after the edge card 104 has been inserted into the connector card slot and rotated into place. In this position, the end 112 of the tongue 108 contacts the surface **104*b* of the edge card 104 in an area close to the edge card notch 104*a* and serves to retain it in place. It is important to note that the retention of the edge card 104 by the latch arm 109 is accomplished primarily by the tongue end 112, and as such, the tongue 108 merely exerts a normal force onto the edge card 104 (downward into the plane of FIG. 15). The tongue 108 has a generally curved exterior profile which the edge card notch 104*a* engages during rotation of the edge card into its proper position within the connector. The notch rides down on this surface until the edge card slips under the end 112 of the tongue 108**.

In European Patent Publication No. 0632542 mentioned above, the latch member includes a pair of shoulders which are provided to fit into semi-circular recesses positioned in the ends of an edge card or DIMM. This structure is established by stamping and forming, and as such, it is difficult to obtain close tolerances by which movement of the DIMM within the connector socket may be kept to a minimum.

It is difficult to form such an engagement tongue 108 with accuracy. Additionally, when multiple insertions of an edge card are required, the tongue 108 may yieldingly deform as it allows the edge card notch 104*a* to repeatedly ride over it into engagement with its ends 112. When the edge card is removed from the connector, the tongue 108 may slightly deform as the edge card is rotated outwardly. In order to reliably perform this engagement function without excessive deformation, the tongue 108 must be accurately formed on the latch arm 109.

Figure 1:
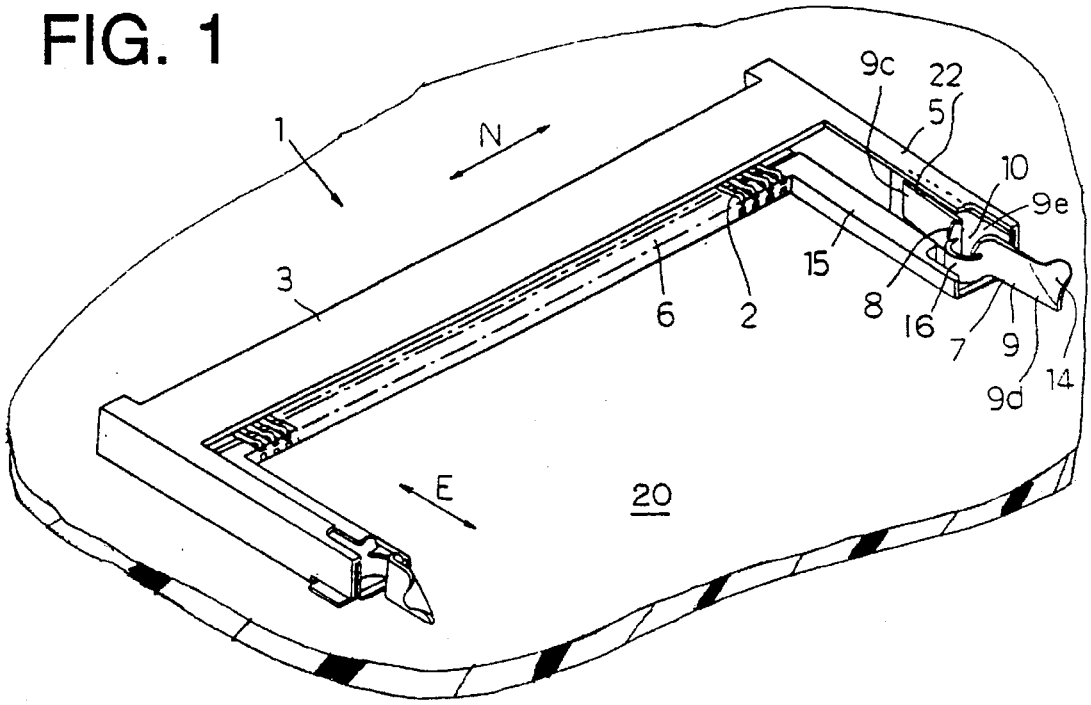
FIG. 1 is a perspective view of an improved circuit card connector constructed in accordance with the principals of the present invention.

The present invention provides a latching mechanism for a connector which applies two retention forces to the edge card in different directions and which may be constructed with very low tolerances, in the order of 0.001 inches, to thereby better control the placement of the edge card or DIMM within the connector. An electrical connector constructed in accordance with the principles of the present invention is illustrated in FIG. 1 generally at 1. The connector 1 includes an elongated housing, or body portion 3, extending between two opposing ends, illustrated as posts 5 integrally formed with the housing 3 and extend outwardly therefrom, shown along direction E in FIG. 1.

The housing 3 includes a plurality of electrical terminals 2 disposed within a series of recesses 120 formed along opposite sides of a edge card receiving slot 6 formed in the connector housing 3. As is known in the art, the terminals 2 are disposed in a spaced-apart fashion along the slot and extend for the length N thereof. The slot 6 receives an engagement edge 4*a* of a secondary circuit board, such as the edge card 4 illustrated. The card slot 6 preferably has a width sufficient to receive the engagement edge 4*a* of the edge card 4 and permit the contact portions of the terminals 2 to engage opposing contact pads formed along the card edge 4*a*. The contact portions of one set of the connector terminals 2 may extend relatively far into the card slot 6 in order to provide a biasing force against the edge card 4 when it is engaged in place within the connector housing 3. The edge card engagement edge is, in effect, "sandwiched" between opposing rows of contact terminals 2 of the card slot 6.

Returning to FIG. 1, the connector end posts 5 have lower portions 15 which, on the bottom surfaces thereof, may engage an upper surface 20 of a mother board and, on the upper surfaces, may provide support to the edge card 4 when it is inserted into the connector 1. The insertion of the edge card 4 is illustrated generally in FIG. 2 wherein it can be seen that the edge card 4 (shown in phantom) is inserted into the card slot 6 of the connector housing 3 at a predetermined angle and subsequently rotated downwardly until the edge card is positioned between the connector end posts 5 and engaged with the latch members 7.

Figure 2:
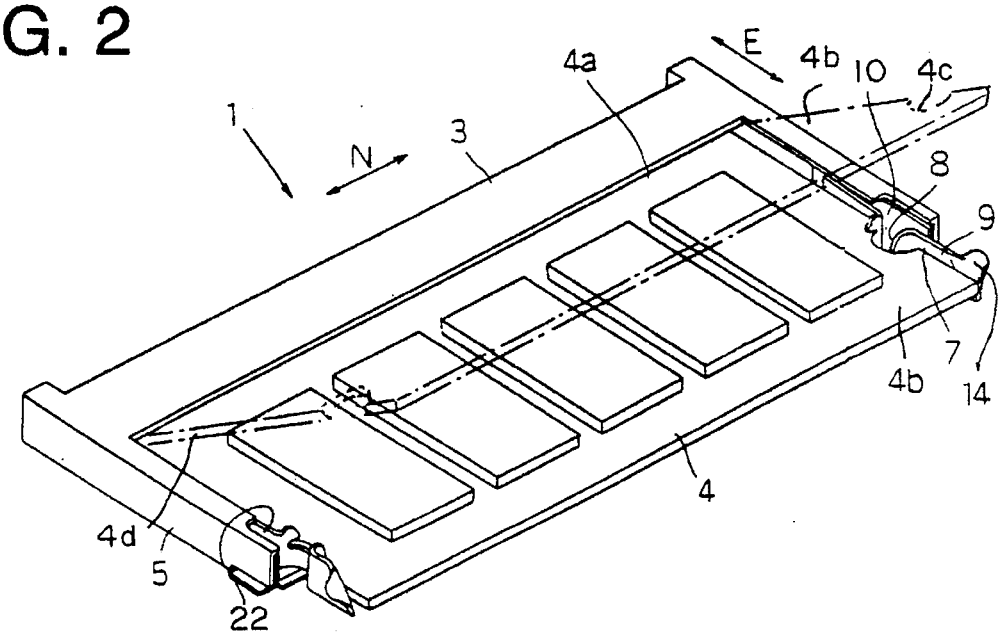
FIG. 2 is a perspective view of the connector of FIG. 1 showing a second card in place within the connector.

In order to retain the edge card 4 in place, the connector is preferably provided with a latching means which retains the edge card in place in at least two directions. This latching means is shown as taking the form of two flexible latch members 7 disposed at the ends of the connectors and partially received within corresponding slots 22 of the end posts 5. (FIGS. 1 & 2.) Each latch member 7 is preferably formed from an elongated flexible and resilient metal strip 9. As shown in phantom in FIG. 1, the metal strip 9 has a lower portion 9*c* which is folded upon itself to define two interconnected arms 9*c*, 9*e* separated by an intervening space 10, which is received within the end post slots 22. Opposing sided of the end post slots 22 are closer together than the interconnected arms 9*c*, 9*e* in a relaxed condition. The lower portion 9*c* and the interconnected arm 9*e* of the latch member 7 are wedged into contact with the opposing sides of the end post slot 22 in order to bias the two arms 9*c*, 9*e* toward each other so that the latch member 7, when inserted into the end post slots 22, assumes a preloaded condition, wherein the two arms 9*c*, 9*e* resist their capture by the walls of the end post slots 22. A card-contacting projection 16 of the latch member 7 must be moved laterally outwardly along the path defined by line N to effect latching of the edge card 4 in the connector 1 to hold the edge card 4 in place within the card slot 6.

Figure 3:
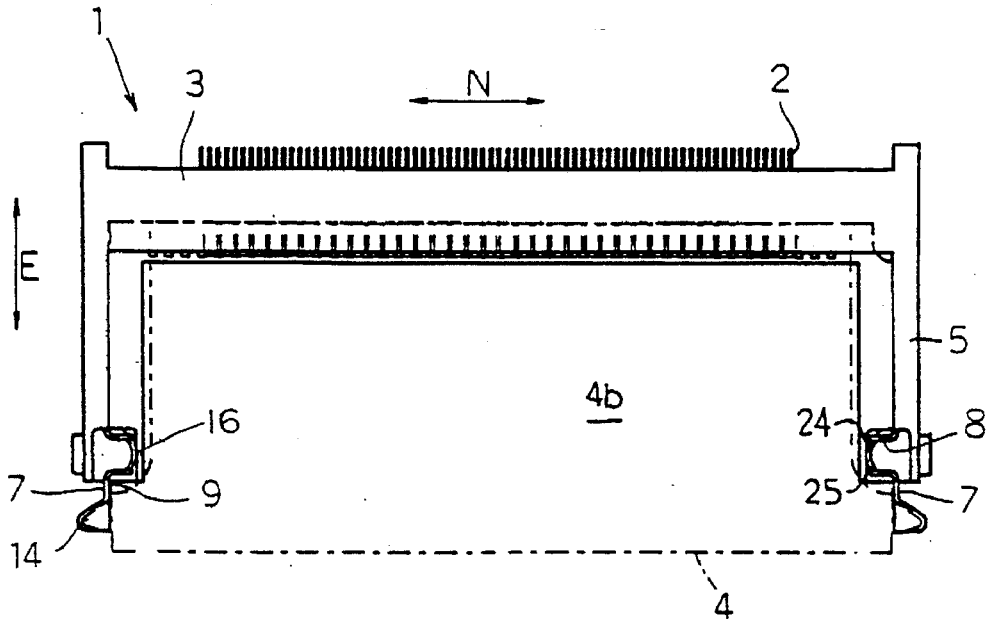
FIG. 3 is top plan view of the connector of FIG. 2.
Figure 4:
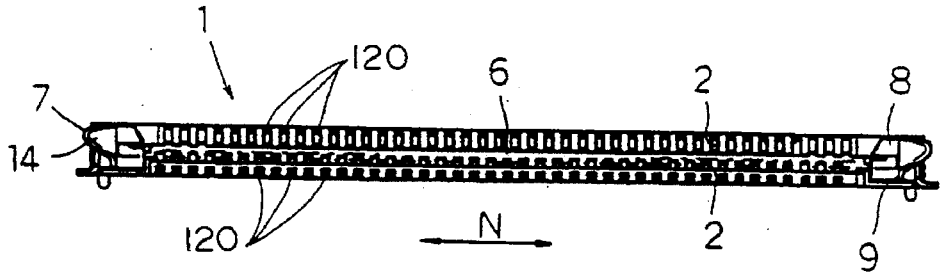
FIG. 4 is an end view of the connector of FIG. 3.
Figure 5:
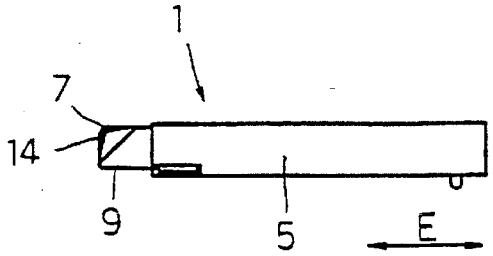
FIG. 5 is an end view of the connector of FIG. 3.
Figure 7:
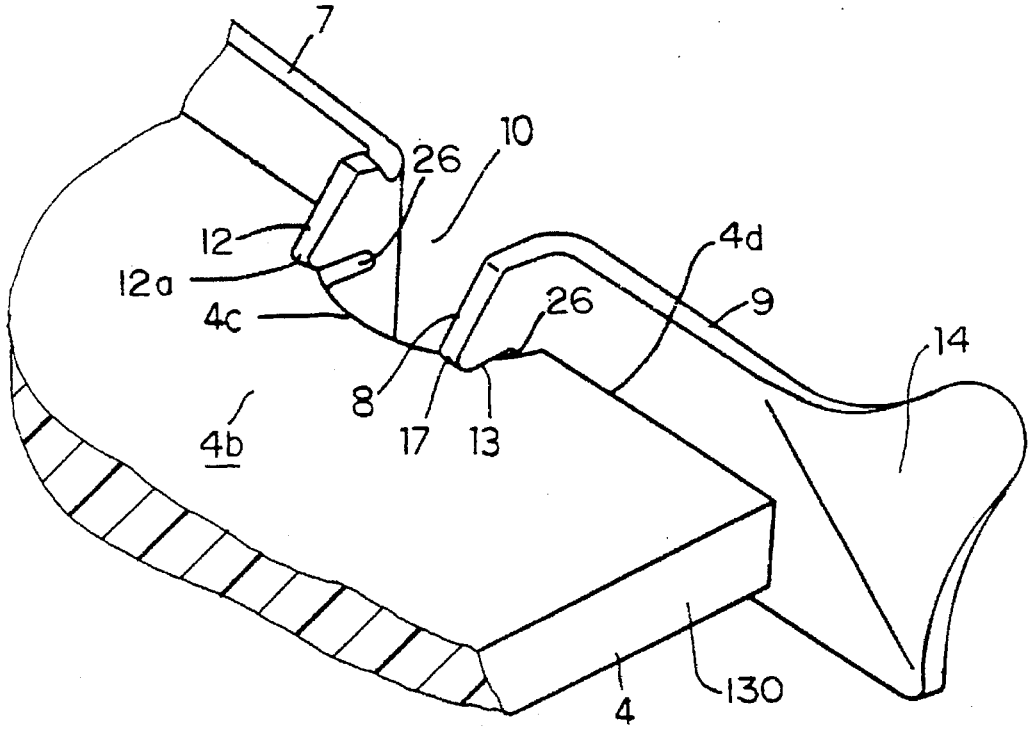
FIG. 7 is an enlarged perspective view of the latch means of FIG. 1 showing a corresponding secondary circuit board in engagement with the latch means.

The latch member 7 further includes means by which the latch member may be manipulated by a user in order to release the edge card from the connector. This manipulating means is illustrated as a projecting end portion 9*d* which generally opposes the end 4*d* of the edge card 4 and extends along the end 4*d* up to the outermost edge 130 of the edge card 4. This end portion 9*d* includes, as illustrated in FIGS. 3 and 7, a tab 14 which is partially bent over the end portion 9*d* away from the edge card 4 about the axis P to provide a surface which facilitates engagement by the fingers of a user. In operation, the edge card 4 may be released from its engagement with the connector 1 when a user pulls the tabs 14 outwardly and away from the edge card ends 4*d*.

Figure 6:
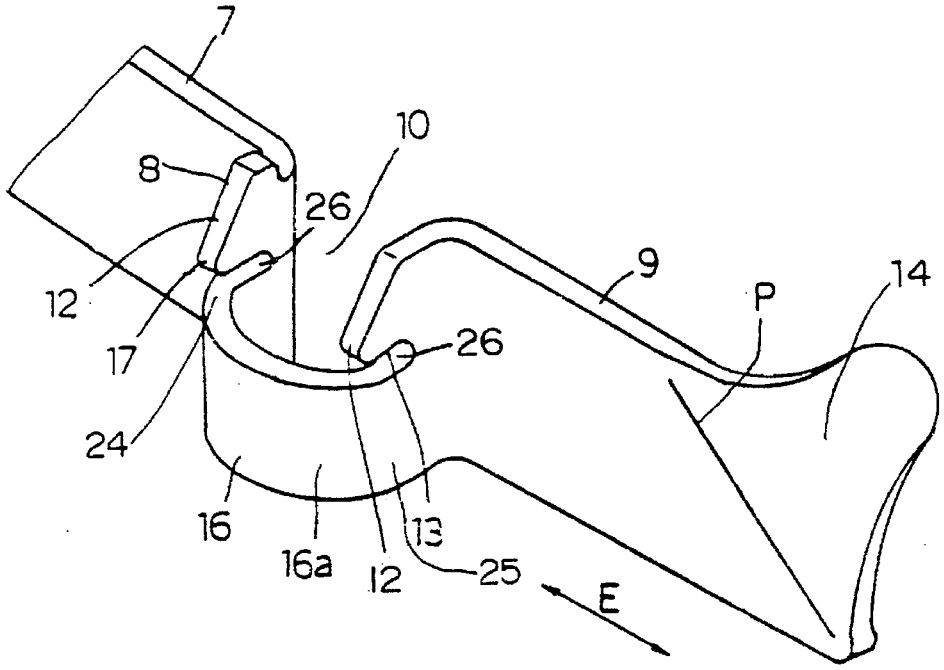
FIG. 6 is an enlarged perspective view of a latch means of the connector of FIG. 1.

As illustrated in FIGS. 3 & 6, the latch member 7 includes the arcuate card-engaging projection 16 which extends inwardly toward the edge card 4 in general alignment with the longitudinal axis N of the card slot 6. The connector of the present invention provides increased connection performance when used with the DIMM-type edge card 4 depicted in FIG. 2 DIMMs typically do not include the redundancy provided for by a SIMM (single in-line memory module) and thus needs a more accurate one to one alignment between its contact pads and a terminal contact portions of the connector. In this regard, the secondary printed circuit board which forms the substrate for a DIMM typically includes notches 4*c* formed in the opposing ends of the edge card 4. In this regard, the card-engaging projections 16 of the connector latch members 7 are aligned with the edge card notches 4*c*. DIMMs are usually smaller in size and more delicate than SIMMs and because of their low profile, they may be mounted closely to the surface 20 of the mother board.

Figure 8:
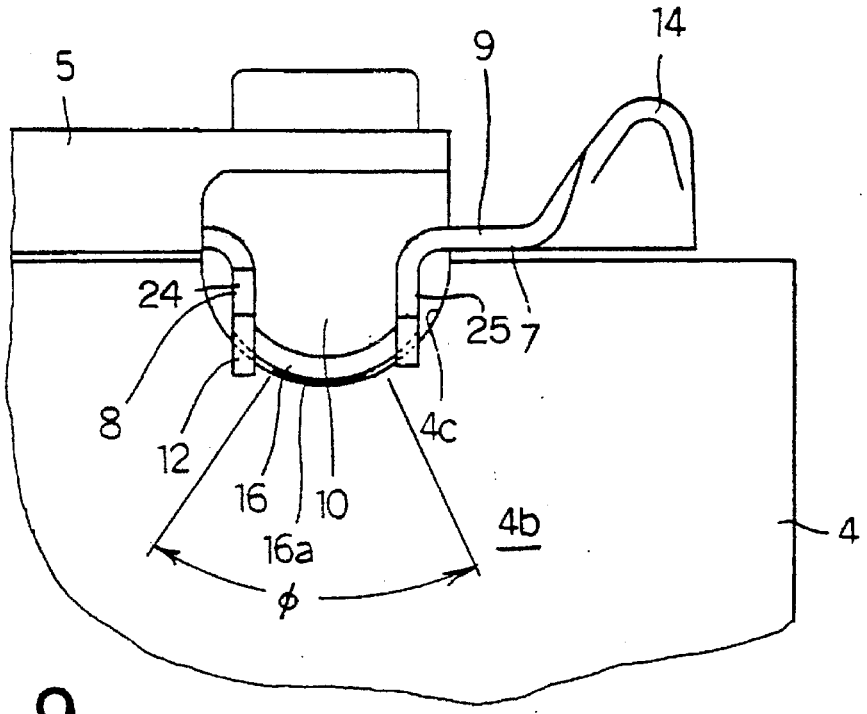
FIG. 8 is a partial plan view of the engagement of the latch means and secondary circuit board of the connector of FIG. 1.
Figure 9:
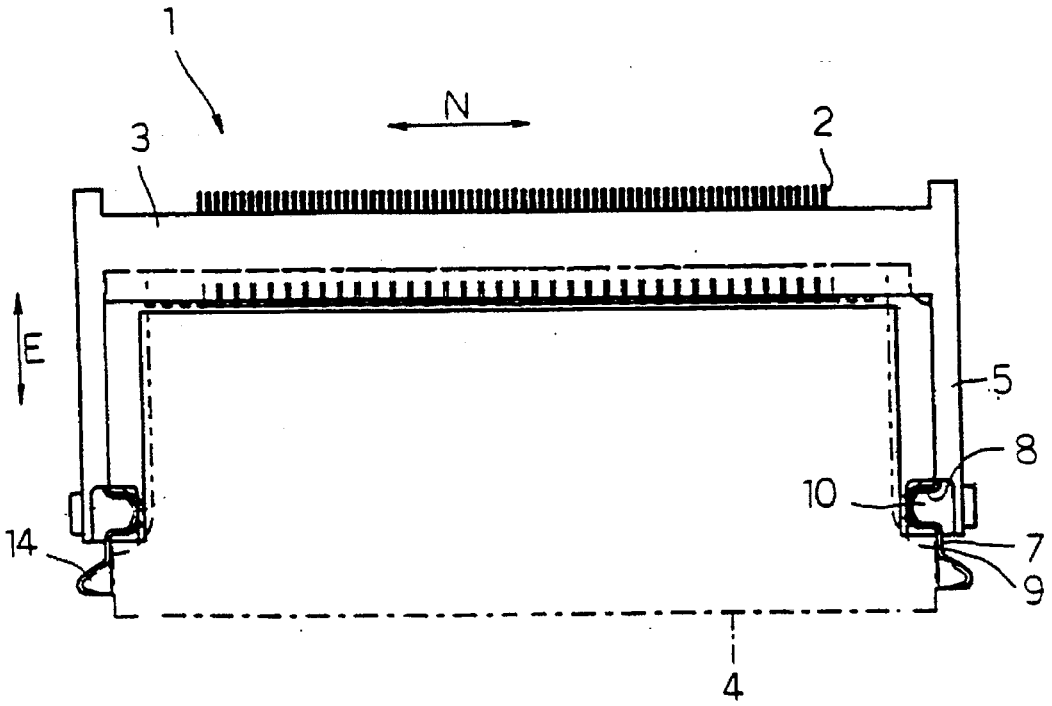
FIG. 9 is a plan view of a second embodiment of a connector constructed in accordance with the principles of the present invention.

The projections 16 preferably have a rounded profile as illustrated and importantly, preferably have radius which approximates that of the edge card notches 4*c* toward the center of the projections 16, but which is overall slightly less than the radius of the notches 4*c*. This is so that the projections 16 may fit within the notch 4*c* of the edge card 4 and ensure card-engaging contact at or near the centerline of the notch 4*c*. The projection 16 is nominally defined by two generally parallel opposing sidewalls 24, 25 and an intermediate portion, or card-contacting portion 16*a*, which interconnects the two sidewalls 24, 25 together. The distance between the sidewalls 24, 25 is less than the overall diameter of the edge card notch 4*c* (FIG. 8) so that the projection 16 will easily fit inside of its corresponding card notch 4*c*, and will concentrate its contact with the edge card 4 near the center of the notch 4*c*. The contact which occurs between the latch member 7 and the edge card 4 occurs along an arc $\phi$. (FIG. 8.)

The card-contacting projection 16 is defined by forming its sidewalls 24, 25 in the latch member between the lower portion 9*c* and the tab portion 9*d* thereof and by further blanking the latch member 7. This blanking defines two distinct portions of the projection, which shall be referred to descriptively herein as "upper" and "lower" sections insofar as these sections have such an orientation with respect to the edge card 4 in the Figures. During the blanking, a slot 26 is formed between the retention arms 8 and the projection lower section 16 so that the projection upper section adopts the configuration of a pair of retention arms 8 in FIG. 6 and retention arms 8' in FIG. 10.

By blanking the slots 26 to form the retention arms 8, the height of the slots 26, that is, the distance between the upper surface of the projection lower section 16 and the abutment surfaces 13 may be controlled to a much higher degree of precision (in the order of 0.001 inches or better) than if the retention arms 8 were stamped and formed from a tab, such as illustrated in FIGS. 13–15. This height control improves the ability of the connector to retain the edge card in place within the connector housing, thereby improving the overall performance of the connector. Additionally, by blanking the retention arms 8, it will be appreciated that the retention arms have a "full" cross-section to resist forces imparted or stresses developed by repeated insertion and removal of the edge card such as is commonly encountered in quality control testing. A full section means that the retention arms may utilize the entire depth of the latch member 7 within the projection sidewalls 24, 25 directly underneath the retention arms 8 and extending toward the junction of the sidewalls 24, 25 with the latch member sections 9*c*, 9*d* which structure is lacking in the connector illustrated in FIGS. 13–15 and that described in said European Patent Publication No. 0632542. The retention arms 8 extend above the projection lower section 16*a* generally along the axes of the two projection sidewalls 24, 25 and slightly outwardly therefrom.

In the embodiment illustrated in FIG. 6, the retention arms 8 terminate in ends 17 located slightly past the intersection of the sidewalls 24, 25 wherein they extend partially past the perimeter of the projection card-contacting portion 16*a*. The retention arm ends 17 define the outermost ends of lower abutment surfaces 13 which engage the confronting surface 4*b* of the edge card 4, when the edge card is installed in the housing 3 as illustrated in FIG. 7. The slot 26, in effect, bifurcates the projection 16 into two distinct portions which collectively engage the edge card 4 in two different planes of engagement. Consequently, the card-containing portions 16*a* of the lower projection sections 16 of the latch members 7 engages the lateral edges 4*d* of the edge card 4 at the interior confronting surface of the edge card slot 4*c*, while the retention arm abutment surfaces 13 of the latch member projection upper section engage the confronting surface 4*b* of the edge card 4. Accordingly, the edge card 4 is effectively retained in the connector 1 in two different planes which are coincident with the plane of the edge card and transverse thereto.

In another important aspect of the present invention, each retention arm 8 is provided with an inclined surface 12 which slopes downwardly in FIGS. 7 and 8 toward the projection lower section 16 and which terminates in an end 12*a*. These inclined surfaces serve as cam surfaces which the inner periphery of the edge card notches 4*c* engage when the edge card is rotated into place as illustrated in FIG. 2. As the edge card 4 is initially rotated into place within the connector, it will be seen that the inner peripheries of the edge card notches 4*c* contact the retention arm inclined surfaces 12. As the rotation of the edge card continues, the edge card rides upon the latch member inclined surfaces 12, applying a force opposite to their preloading and causing them to spread laterally outwardly in the direction indicated by the arrow M, thereby forcing the retention arm 8 and the latch members 7 laterally outwardly within the connector end slots 22 until the edge card snaps under the retention arms 8, whereupon the latch members 7 "snap" back toward the edge card 4 so that the retention arm abutment surfaces 13 contact the edge card surface 4*b*.

Figure 10:
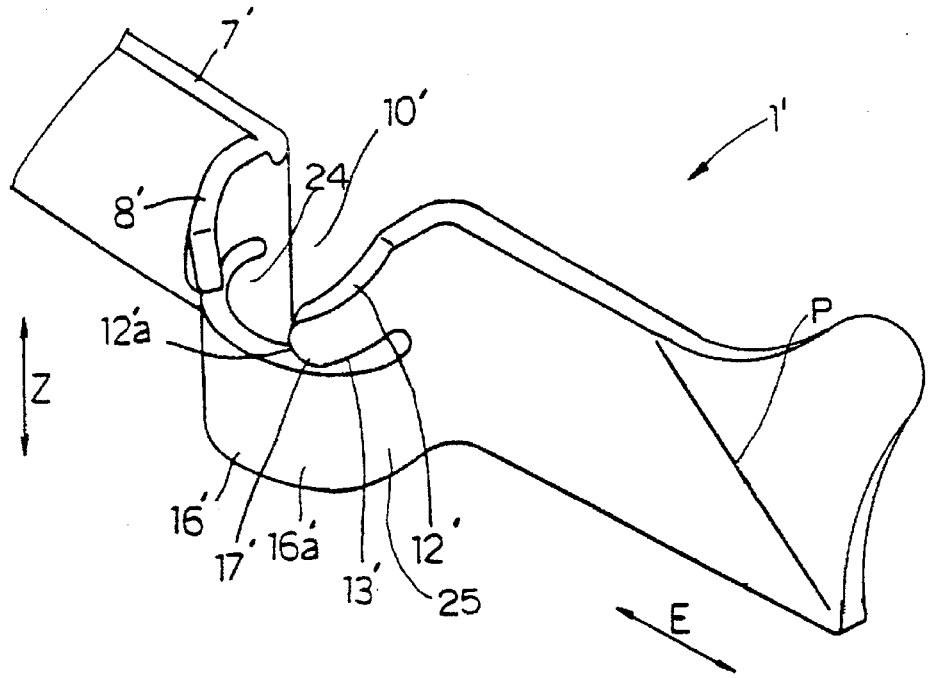
FIG. 10 is an enlarged perspective view of a latch means of the alternate embodiment of the connector illustrated in FIG. 9.
Figure 11:
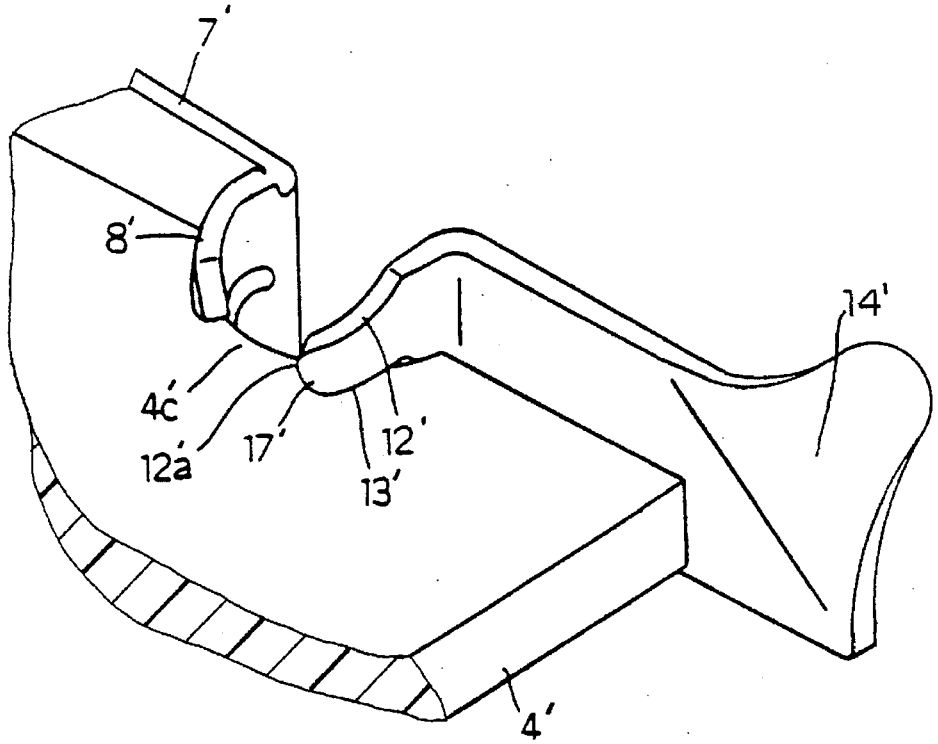
FIG. 11 is an enlarged perspective view of a latch means of the alternate embodiment of the connector but showing a secondary circuit card in engagement with the latch means.
Figure 12:
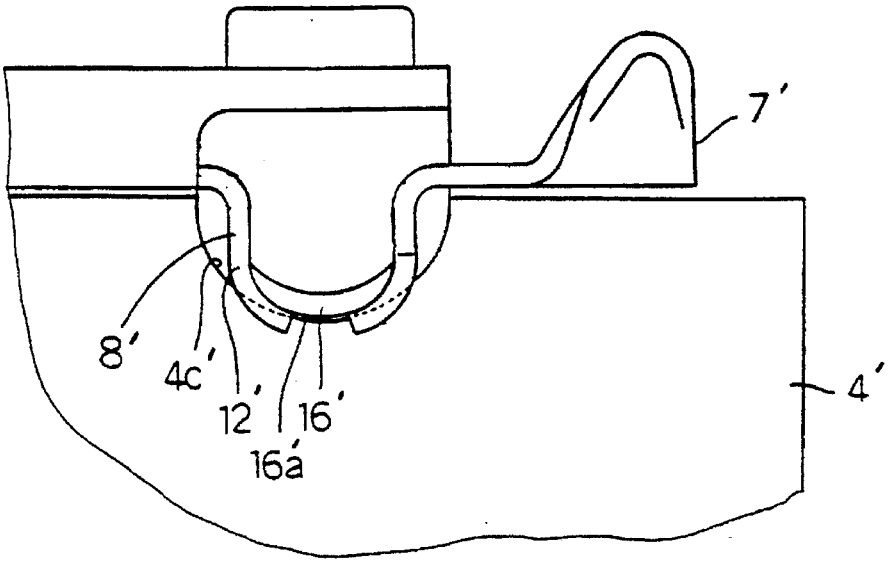
FIG. 12 is an enlarged plan view of FIG. 11 illustrating the engagement of the latch means and secondary circuit board.

Another embodiment of a connector 1' having a latch mechanism of the present invention is illustrated in FIGS. 10 & 11. In this embodiment, the retention arms 8' have a generally curved configuration and include curved inclined surfaces 12' which incline gradually toward the edge card 4' and which terminate at ends 12*a'* to define a pair of retention arms with end portions 17' that extend past the perimeter of lower contact portion 16*a'* and the perimeter of the edge card notch 4*c'*. The retention arms 8' also include abutment surfaces 13' on their lower surfaces which are defined in part by the slot which separates the upper and lower sections of the latch member projection 16'.

Although in this description the connector 1 is described as being mounted to a mother board such that the connector assumes a generally horizontal position with respect to the mother board, it will be understood that the connector 1 may also be mounted on a mother board in a generally vertical orientation and still obtain the benefits and advantages of the invention.

For example, in a DIMM type edge card, as depicted in FIGS. 1–12, any rotation of the edge card 4 in and out of the connector 1 will impact upon the latch members 7. The use of two retention arms 8 for each latch member 7 will give better edge card retention with respect to the area of the circuit board engaged by the latch members 7. The notches 4*c* of the edge card 4 ride upon the blanked retention arm cam surfaces 12 which permits the latch members 7 to accommodate entry of the edge card 4 into engagement with the connector 1. Once the edge card 4 is engaged, the interior central portions of the projections 16 will engage the edge card and provide shock resistance to the connector to maintain the edge card in lateral alignment with the card slot terminals 2.

Additionally, it will be appreciated that the second embodiment of the invention depicted in the Figures, with its curved retention arm cam surfaces 12' will provide more cam surface than with the straight cam surfaces of the first embodiment which, to a degree, will provide an easier force to press the edge card 4' into engagement with the latch member 7'.

Accordingly, it will be appreciated that the embodiments of the present invention have discussed herein are merely illustrative of a few applications of the principles of the invention. Numerous modifications may be made by those skilled in the art without departing from the true spirit and scope of the invention.

The invention claimed is:

1. In an electrical connector for providing an electrical connection between a plurality of card contacts on a circuit card generally adjacent a first edge thereof and a plurality of board contacts on a circuit board, the circuit card being generally planar and having first and second faces, said first and second faces each having a row of card contacts generally parallel to and adjacent to the circuit card first edge, said connector including an insulative housing having a lower face for positioning adjacent said circuit board, an upper face having a card slot therein for receiving said circuit card first edge and a plurality of contact element receiving cavities spaced along the card slot and in communication therewith, said circuit card being first inserted into said card slot and rotated into engagement with said card slot, the connector further having means to latch said circuit card into engagement with said connector and to release at least a portion of said circuit card from said connector after said circuit card first edge has been rotated into engagement with said card slot, the improvement comprising, in combination:

said means to latch and release said circuit card including at least one latch member disposed within one end of said connector housing, the latch member having a pair of interconnected arms separated by an intervening space, the distance between said arms being greater than the dimension of said connector end housing which receives said latch member such that said latch member is preloaded when in said connector housing end, said latch member further being movable between a first operative position wherein said latch member engages said circuit card and a second operative position wherein said latch member does not engage said circuit card, said latch member further including a circuit card-contacting portion stamped and formed in one of said latch member arms, the card-contacting portion extending outwardly from said latch member and having distinct first and second engagement members which engage separate, first and second portions of said circuit card, the circuit card portions lying in separate planes when said circuit card is inserted into said connector housing and rotated within said card slot and said latch member is in said first operative position, said latch member first engagement member including an arcuate projection which is received within a corresponding notch of said circuit card when said latch member is in said first operative position, said latch member second engagement member including at least one circuit card retention arm, the retention arm having two intersecting surfaces, one of said surfaces including a cam surface disposed thereon which guides said circuit card into engagement with said latch member on rotation thereof, said retention arm being separated from said arcuate projection by a blanked slot and overhanging said arcuate projection, the other of said retention arm intersecting surfaces being an abutment surface which opposes said projection.

2. The electrical connector of claim 1, wherein said connector includes two latch members disposed at opposite ends of said connector housing.

3. The electrical connector of claim 1, wherein said latch member is formed from a resilient metal.

4. The electrical connector of claim 1, wherein said latch member second engagement member includes two retention arms spaced apart from each other.

5. The electrical connector of claim 1, wherein said latch member projection includes two generally parallel sidewalls interconnected by an intervening arcuate portion, the arcuate portion engaging a segment of said circuit card notch.

6. The electrical connector of claim 1, wherein said cam surface is an inclined planar surface.

7. The electrical connector of claim 1, wherein said cam surface is an inclined curved surface.

8. The electrical connector of claim 1; wherein said retention arm is blanked out of a portion of said latch member projection.

9. The electrical connector of claim 8 wherein the abutment surface comprises an edge of said retention arm.

10. The electrical connector of claim 1, wherein said latch member includes an additional retention arm spaced apart from said retention arm, the additional retention arm including intersecting cam and abutment surfaces, said additional retention arm also being separated from said latch member projection by an intervening slot and said second retention arm abutment surface further overhanging said projection.

11. The electrical connector of claim 10, when said latch member projection includes two spaced apart sidewalls and said two retention arms are generally aligned with and spaced apart from said projection sidewalls.

12. The electrical connector of claim 11, wherein said retention arm cam surfaces are curved and are further generally inclined toward said latch member projection.

13. An edge card connector for providing an electrical connection between a first plurality of contacts on a primary circuit member and a second plurality of contacts on a printed circuit card, the printed circuit card having the second plurality of contacts disposed on an edge thereof, the circuit card edge being inserted into and rotated into engagement with said connector so that a connection is effected between said first and second plurality of contacts, said connector comprising:

a connector housing having an elongated card slot disposed therein and extending between two opposing end portions of said connector, the card slot having a predetermined longitudinal axis and being adapted to receive said circuit card edge therein in electrically operative relationship, the connector housing being defined by two generally parallel sidewalls, a plurality of contact terminals disposed in said card slot, each terminal having a portion for slidingly engaging said circuit card upon insertion into and rotation of said circuit card within said card slot, a latch mechanism in operative connection with at least one end of said connector housing, the latch mechanism including an elongated latch member which is movable between a first position in which said latch member engages said circuit card to retain it within said card slot and a second position in which said latch member releases said circuit card and at least a portion of said circuit card is displaced from said connector, the latch member having a body portion and a projecting portion which projects from the body portion to contact a lateral edge of said circuit card within a reentrant portion of said circuit card when said latch member is in said first position, the projecting portion having first and second distinct circuit card engagement members, the first engagement member including an arcuate projection formed in said body portion, the second engagement member including a pair of retention arms which extend over the arcuate projection and which are spaced apart from each other on opposite sides of a centerline of said arcuate projection, said retention arms being blanked from said latch member body portion adjacent said arcuate projection and further being separated from said arcuate projection by a pair of intervening blanked slots which cooperate to define a surface of said arcuate projection which opposes said retention arms.

14. The connector as defined in claim 13, wherein said retention arms are generally linear in configuration and include inclined surfaces positioned above at least a portion of said arcuate projection, the inclined surfaces defining cam surfaces which said circuit card rides upon when rotated within said card slot to thereby move said latch member between said first and second portions.

15. The connector as defined in claim 13, wherein said retention arms extend over said arcuate projection and cooperate with said arcuate projection to define a card-receiving space associated with said latch member.

16. The connector as defined in claim 13, wherein said retention arms are curved and include inclined curved surfaces which define cam surfaces disposed on opposite sides of said projecting portion centerline, said circuit card engaging said cam surface during rotation of said circuit card within said card slot.

17. The connector as defined in claim 16, wherein said retention arm cam surfaces have generally the same curvature as said arcuate projection.

18. An edge card connector for receiving the edge of a circuit card comprising:

an elongated housing having an elongated circuit card slot longitudinally extending therein between two opposing ends of the housing, said housing having a plurality of spaced apart contact terminal-receiving cavities, each of said cavities including a resilient contact terminal therein to form an array of contact terminals along each side of said card slot, the contact terminals engaging opposing contact pads disposed along said circuit card edge when said circuit card edge is inserted into said card slot and said circuit card is rotated partially about said card slot;

said connector further including two latch members disposed in said opposing ends of said housing, said latch members being movable between first and second operative positions, each of said latch members including a body portion, a card-engagement portion and an actuator portion, the latch member body portion including a pair of spaced apart arms which are held within said housing opposing ends under a preloaded condition, the card-engagement portions of said latch members being disposed on respective arms of said body portions and extending therefrom toward said card slot, the actuator portions extending from said body portions and defining means for manually moving said latch members between said first and second operative positions, said card-engagement portions including arcuate projections which are received in notches formed in lateral opposing ends of said circuit card when said circuit card is engaged in place within said card slot and said latch member is in said first operative position, said card-engagement portions further including pairs of retention arms associated with said arcuate projections and separated therefrom by intervening blanked spaces, the retention arms including abutment surfaces which extend along portions of said arcuate projections and project past said arcuate projections to define card receiving spaces which respectively simultaneously engage different planes of said circuit card.

19. The electrical connector of claim 18 wherein the abutment surfaces comprise edges of said retention arms.

* * * * *